US006757149B2

(12) United States Patent
Moran

(10) Patent No.: US 6,757,149 B2
(45) Date of Patent: Jun. 29, 2004

(54) METHOD FOR CONTROLLING FUEL INJECTOR VALVE SOLENOID CURRENT

(75) Inventor: Kevin David Moran, Trenton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 96 days.

(21) Appl. No.: 10/090,274

(22) Filed: Mar. 4, 2002

(65) Prior Publication Data

US 2003/0165039 A1 Sep. 4, 2003

(51) Int. Cl.[7] ..... H01H 9/00
(52) U.S. Cl. ..... 361/160; 361/154; 123/490
(58) Field of Search ..... 361/152, 154, 361/160, 187, 195, 196; 123/490; 239/585.1, 585.2, 478

(56) References Cited

U.S. PATENT DOCUMENTS 4,169,372 A * 10/1979 Colwill et al. ..... 73/862.18
4,174,694 A * 11/1979 Wessel et al. ..... 123/357
5,220,259 A * 6/1993 Werner et al. ..... 318/432
6,024,071 A * 2/2000 Heimberg et al.
6,113,014 A * 9/2000 Coldren et al. ..... 239/585.1
6,122,158 A * 9/2000 Weber ..... 361/154

FOREIGN PATENT DOCUMENTS

GB 2310540 * 8/1997

* cited by examiner

*Primary Examiner*—Anthony Dinkins
(74) *Attorney, Agent, or Firm*—Brinks Hofer Gilson & Lione

(57) ABSTRACT

A method of controlling a fuel injector valve solenoid includes generating a set-point signal which models a desired current profile flowing through the valve solenoid, providing a current controller which is adapted to regulate the current flowing through the valve solenoid, and regulating the current flowing through the valve solenoid such that the current flowing through the valve solenoid closely matches the set point signal. Regulating the current includes measuring the current flowing through the valve solenoid, comparing the current flowing through the valve solenoid to the current profile of the set-point signal, and adjusting the current flowing through the valve solenoid to more closely match the current profile of the set-point signal.

14 Claims, 5 Drawing Sheets

METHOD FOR CONTROLLING FUEL INJECTOR VALVE SOLENOID CURRENT

TECHNICAL FIELD

The present invention generally relates to a method of controlling the valve within a fuel injector. More specifically, the present invention relates to a method of controlling the electrical current through a solenoid which opens and closes the valve of the fuel injector.

BACKGROUND

Within an internal combustion engine fuel injector, a valve selectively opens and closes to either allow fuel to flow through the fuel injector or to stop fuel from flowing through the fuel injector. Typically, the valve within a fuel injector is controlled by a spring and a solenoid, wherein the valve overcomes the force of the spring and opens when an electrical current is supplied to the solenoid, and the spring forces the valve to close when the electrical current is removed. When an electrical voltage is first supplied across the solenoid, there is a lag time before the opening of the valve. During this lag time the magnetic circuit energizes and the current through the solenoid, which is predominantly an inductor, increases until reaching a sufficient level to start moving the valve. Similarly, when the electrical current through the solenoid is removed, the energy stored in the inductor of the solenoid must be dissipated before the spring begins to close the valve. Fuel flowing through the fuel injector will not stop until the current through the solenoid dissipates enough to allow the valve to close.

This lag time causes hesitation before fuel is supplied through the fuel injector, and causes additional fuel to flow into the cylinder of the engine before the valve fully closes. Long and unpredictable lag times cause errors in fuel timing and volume, negatively affecting fuel economy, emissions, and performance. Therefore, there is a need for an improved method of controlling the opening and closing of the valve within an internal combustion engine fuel injector that will minimize the lag time between opening and closing of the valve.

DETAILED DESCRIPTION OF THE INVENTION

The following description of the preferred embodiment of the invention is not intended to limit the scope of the invention to this preferred embodiment, but rather to enable any person skilled in the art to make and use the invention.

Figure 2:
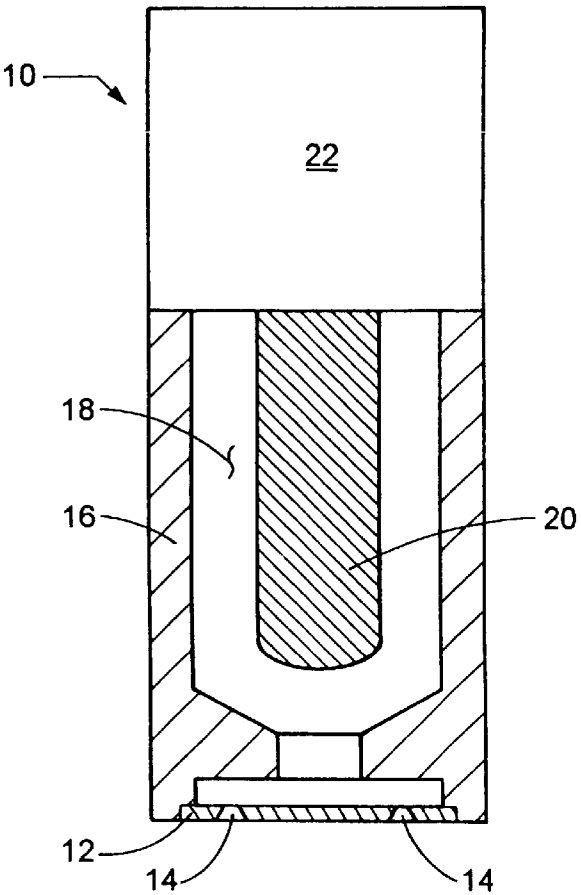
FIG. 2 is a sectional view similar to FIG. 1, where the valve is shown open.
Figure 1:
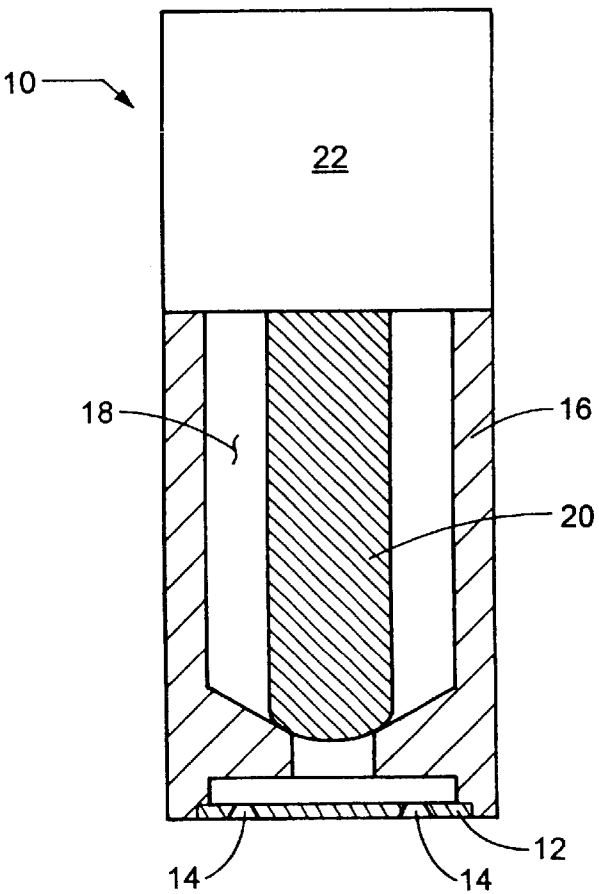
FIG. 1 is a sectional view of a fuel injector incorporating the method of the preferred embodiment, where a valve within the fuel injector is shown closed.

A method of the present invention controls the opening and closing of a fuel injector valve to minimize the lag time between being completely closed and completely open, and the lag time between being completely open and completely closed. Referring to FIGS. 1 and 2, a fuel injector assembly is shown generally at 10. The fuel injector 10 includes a nozzle plate 12 having a plurality of orifice holes 14 extending therethrough. The nozzle plate 12 is mounted onto the end of a fuel injector body 16. The fuel injector body 16 includes a fuel flow passage 18 that is adapted to transfer fuel. Fuel flows through the fuel flow passage 18 to the nozzle plate 12 and is injected into a cylinder of an engine. The fuel injector 10 includes a valve 20 that selectively prevents fuel from flowing through the fuel flow passage 18. The valve 20 is controlled by a valve solenoid 22 that moves the valve 20 back and forth between a closed position, as shown in FIG. 1, and an open position, as shown in FIG. 2. The opening and closing of the valve 20 is controlled by providing an electrical current to the valve solenoid 22.

Figure 3:
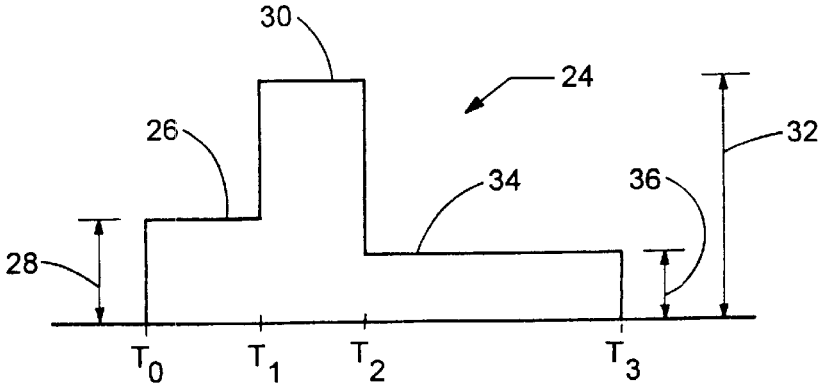
FIG. 3 is a graph showing the current profile of a set-point signal of the method of the preferred embodiment.

The method includes generating a set-point signal, shown generally in FIG. 3 and designated as reference number 24, which models a desired electrical current profile flowing through the valve solenoid 22. The method further includes regulating the current flowing through the valve solenoid 22 such that the current flowing through the valve solenoid 22 matches as closely as possible the set point signal 24. The step response of the solenoid current is determined by the applied voltage and the inductance of the valve solenoid 22.

The current profile of the set-point signal 24 preferably describes discrete phases of the current flowing to the valve solenoid 22 during a single cycle of the valve 20. In operation, it is important to open and close the valve 20 as quickly as possible, therefore, prior to actually opening the valve 20, current is supplied to the valve solenoid 22 to pre-charge the solenoid 22. During this pre-charge phase 26, the current supplied to the valve solenoid 22 is increased up to an amplitude 28, or current level, that is slightly less than required to open the valve 20. The amplitude 28 of the pre-charge phase 26 is established based upon the valve 20 characteristics. The duration, $T_1$, of the pre-charge phase 26 is based upon the energizing speed of the valve solenoid 22. The length of time, T1, of the pre-charge phase 26 must be sufficient to energize the valve solenoid 22 to a point slightly below the level required to open the valve 20. If there is no initial current supplied to the valve solenoid 22 then the valve 20 will experience a lag time while the valve solenoid 22 energizes to the point necessary to open the valve 20. By pre-charging the valve solenoid 22, this lag time is reduced or eliminated.

To open the valve 20, the current through the valve solenoid 22 is increased as quickly as possible until the valve 20 is completely open. Maximizing the current into the valve solenoid 22 during the valve 20 opening period decreases the valve opening time, making prediction of fuel volume delivered more accurate. This quick increase in the current, or peak phase 30, has an amplitude 32 that is significantly higher than is necessary to cause the valve 20 to open. The amplitude 32 of the peak phase 30 is established by the level of current necessary to open the valve 20, and by increasing the peak phase 30 current to a level that will maximize the opening speed of the valve 20. This high amplitude current causes the valve 20 to open quickly, thereby reducing the amount of time for the valve 20 to transition from closed to open. The time duration, $T_2-T_1$, of the peak phase 30 is just long enough to allow the valve 20 to open completely and settle into its open position. This time will depend upon the physical characteristics of the valve 20, valve solenoid 22, voltage, and the amplitude 32 of the peak phase 30.

Once the valve 20 is opened, the high level current of the peak phase 30 is no longer necessary. During a hold phase 34 of the current profile, the current flowing through the valve solenoid 22 is lowered to an amplitude 36 that is just sufficient to hold the valve 20 open. Due to friction, hysterisis, and other physical characteristics of the valve 20, the level of current necessary to hold the valve open is different than the level of current necessary to open the valve from a closed position. As shown in FIG. 3, the amplitude 36 of the hold phase 34 needed to hold the valve 20 open is preferably less than the amplitude 28 of the current needed to open the valve 20, although, depending upon the valve 20, the opposite could also be true. The amplitude 36 of the hold phase 34 is established based upon the physical characteristics of the current application. The time duration, $T_3-T_2$, of the hold phase 34 is established based upon how long fuel is to be injected through the valve 20. Fuel will flow through the valve 20 until the hold current is discontinued, and the valve 20 closes again.

Figure 4:
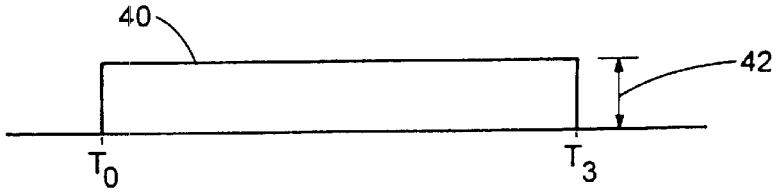
FIG. 4 is a graph showing the current profile of a hold pulse generated by the method of the preferred embodiment.

When generating the set-point signal 24, an input signal is provided. The input signal is generated by an electrical component of the vehicle, preferably, the powertrain control module, or PCM. The input signal coincides with the desired injector activation cycle. From the input signal, an input pulse 40 is generated having a current amplitude 42 equal to the amplitude 36 of the hold phase 34. The time duration, or the length of the input pulse 40 is equal to the sum of the durations of the pre-charge phase, the peak phase, and the hold phase, which is equal to $T_3$, as shown in FIG. 4.

Figure 6:
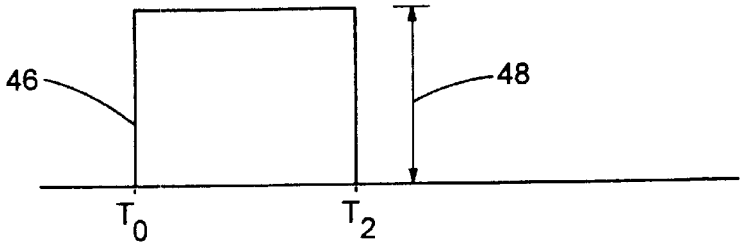
FIG. 6 is a graph showing the current profile of a peak pulse generated by the method of the preferred embodiment.
Figure 5:
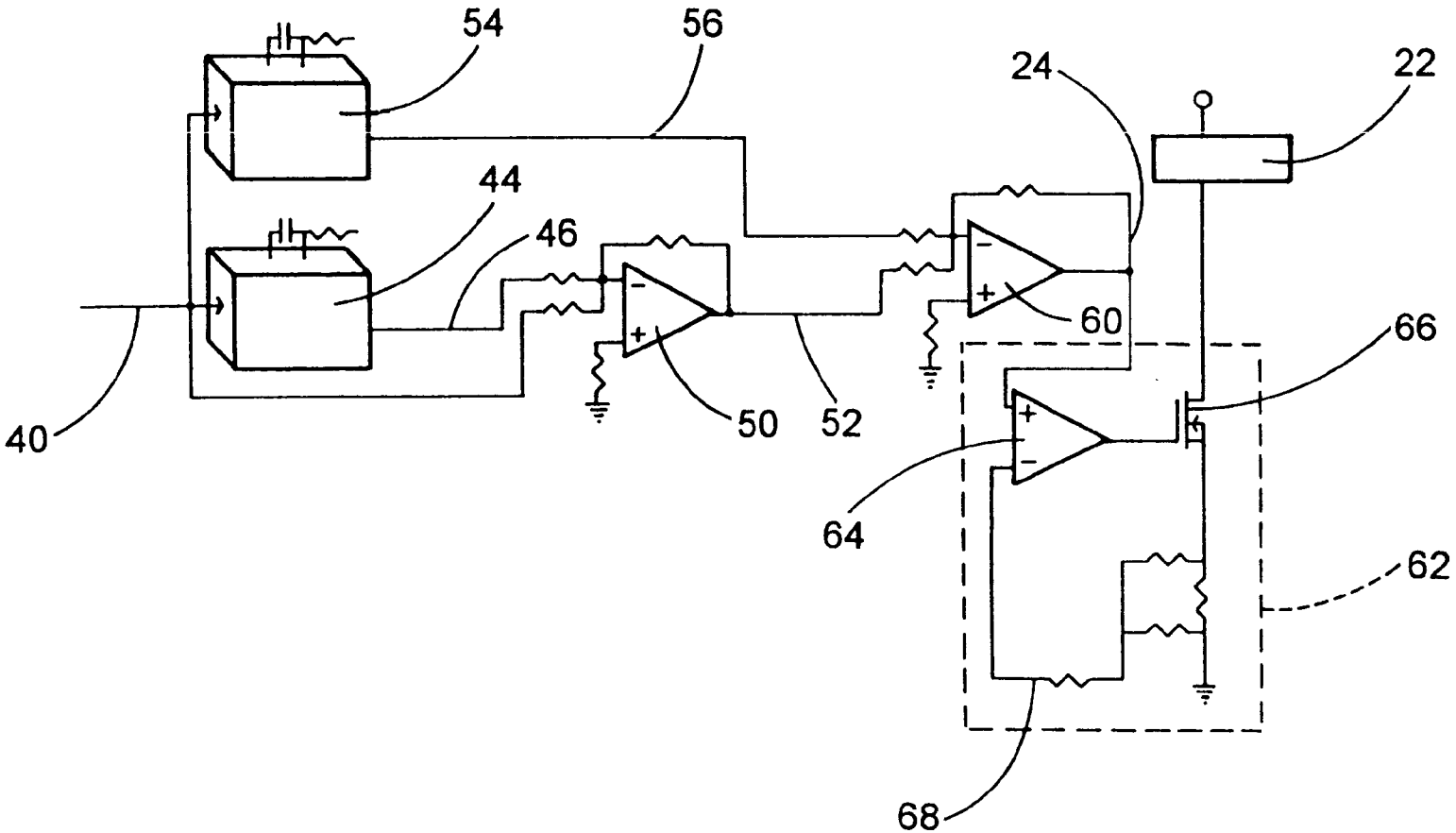
FIG. 5 is a schematic view illustrating the components of the preferred embodiment.

Referring to FIG. 5, the input pulse 40 is sent to a first edge triggered one-shot device 44. The first edge triggered one-shot device 44 is adapted to generate a peak pulse 46 in response to receiving the input pulse 40. The peak pulse 46 has an amplitude 48 equal to the peak amplitude 32 less the hold amplitude 36 and a time duration, $T_2$, equal to the combined pre-charge time and peak time, as shown in FIG. 6.

Figure 7:
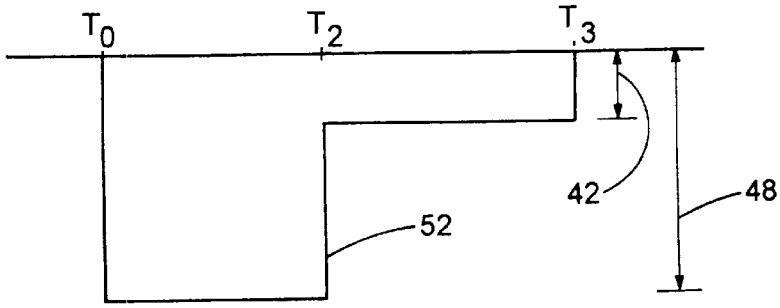
FIG. 7 is a graph showing the current profile of an inverted peak-hold pulse generated by the method of the preferred embodiment.

The peak pulse 46, and the input pulse 40 are input into a first inverting summer operation amplifier 50. The first inverting summer operation amplifier 50 is adapted to combine and invert the two incoming signals 46, 40. The peak pulse 46 and the input pulse 40 are combined and inverted by the first inverting summer operation amplifier 50 to generate a peak-hold pulse 52, as shown in FIG. 7.

Figure 8:
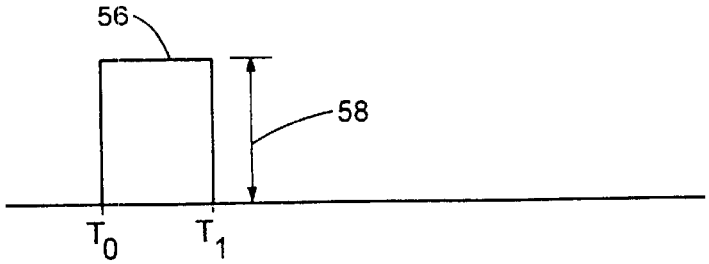
FIG. 8 is a graph showing the current profile of a pre-charge pulse generated by the method of the preferred embodiment.

Additionally, the input pulse 40 is input into a second edge triggered one-shot device 54 adapted to generate a pre-charge pulse 56 in response to receiving the input pulse 40. The pre-charge pulse 56 has an amplitude 58 equal to the difference between the peak amplitude 32 and the pre-charge amplitude 28 and a time duration equal to the pre-charge time, $T_1$, as shown in FIG. 8.

A second inverting summer operation amplifier 60 receives the pre-charge pulse 56 and the peak-hold pulse 52, combines and inverts the two incoming signals 56, 52, and generates the set-point signal 24.

In regulating the current, a current controller 62 measures the current flowing through the valve solenoid 22 and compares that current to the current profile of the set-point signal 24. The current controller 62 then adjusts the current flowing through the valve solenoid 22 to more closely match the current profile of the set-point signal 24.

In the preferred embodiment, the current controller 62 includes an operational amplifier 64, a field effect transistor 66, and a current sensing device 68. The field effect transistor 66 is positioned in series with the valve solenoid 22, whereby limiting the current flowing through the field effect transistor 66 will limit the current flowing through the valve solenoid 22. The operational amplifier 64 is adapted to receive the set point signal 24. The current sensing device 68 senses the current flowing through the field effect transistor 66 and sends a signal back to the operational amplifier 64. The current sensing device 68 can be any appropriate device which will sense the current flowing through the field effect transistor 66. The operational amplifier 64 then compares the current flowing through the field effect transistor 66 to the current profile of the set-point signal 24 and adjusts the current flow through the field effect transistor 66 to more closely match the current profile of the set-point signal 24. As the flow of current through the field effect transistor 66 is adjusted, the flow of current through the valve solenoid 22 is also adjusted.

Mathematically, the set-point current profile can be described as:

$$Isp=-[-\{I1*(U(T_0)-U(T_3))+I2(U(T_0)-U(T_2)\}+\{I3*(U(T_0)-U(T_1)\}]$$

Where the initial current is zero, U(T) is defined as a rising edge unit step at time=T, and Isp is the set-point current. I1 is the hold current 36, I2 is the difference between the peak current 30 and the hold current 36, and I3 is the difference between the peak current 30 and the pre-charge current 28. The input pulse 40 is defined by $(U(T_0)-U(T_3))$, the peak pulse 46, provided by the first one shot device 44, is defined by $(U(T_0)-U(T_1))$, and the pre-charge pulse 56, provided by the second one-shot device 54, is defined by $(U(T_0)-U(T_2))$.

One of the advantages of the present method is that the circuitry can be easily modified to control the current of different valve solenoids having different current profiles. By replacing resistors within the one-shot devices 44, 54 and the operational amplifiers 50, 60, 64, pulses having different amplitudes and time durations can be generated. This allows the same current controller 62 to be adaptable to many different valve applications.

Additionally, in some conventional current control methods, a DC converter is required to increase the voltage of the control signal to operate the solenoid. DC converters are generally expensive and inefficient. The method of the present invention provides a low-voltage signal that can be generated by a conventional 12–14 volt electrical system. The operational amplifier 64 of the current controller 62 is equipped with gains to multiply the current profile of the set-point signal 24. The current controller 62 then provides regulation of the current through the valve solenoid 22 based upon the current profile of the set-point signal 24.

Figure 9:
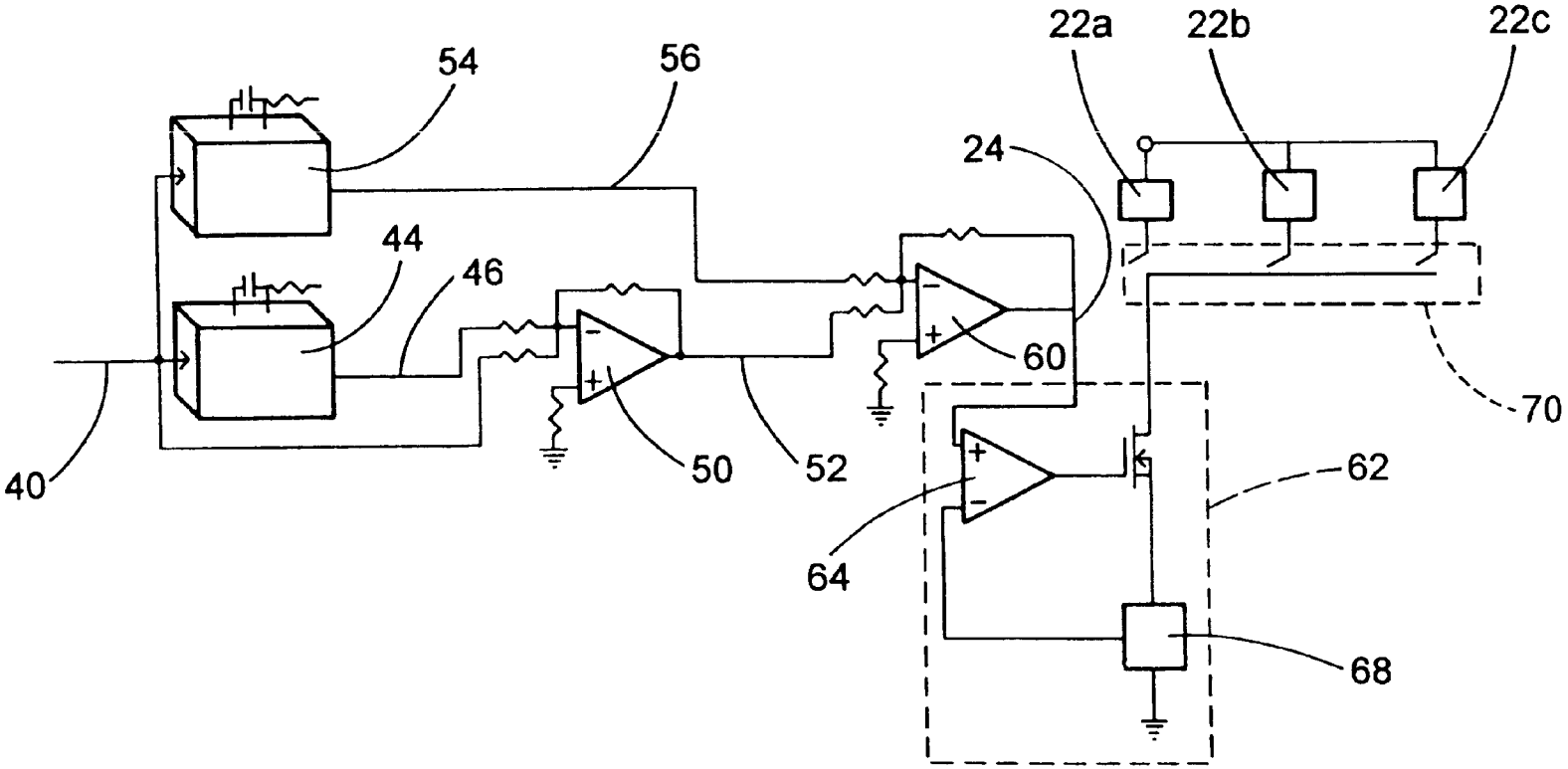
FIG. 9 is a schematic view illustrating the components shown in FIG. 5, wherein the current controller controls three valve solenoids.
Figure 10:
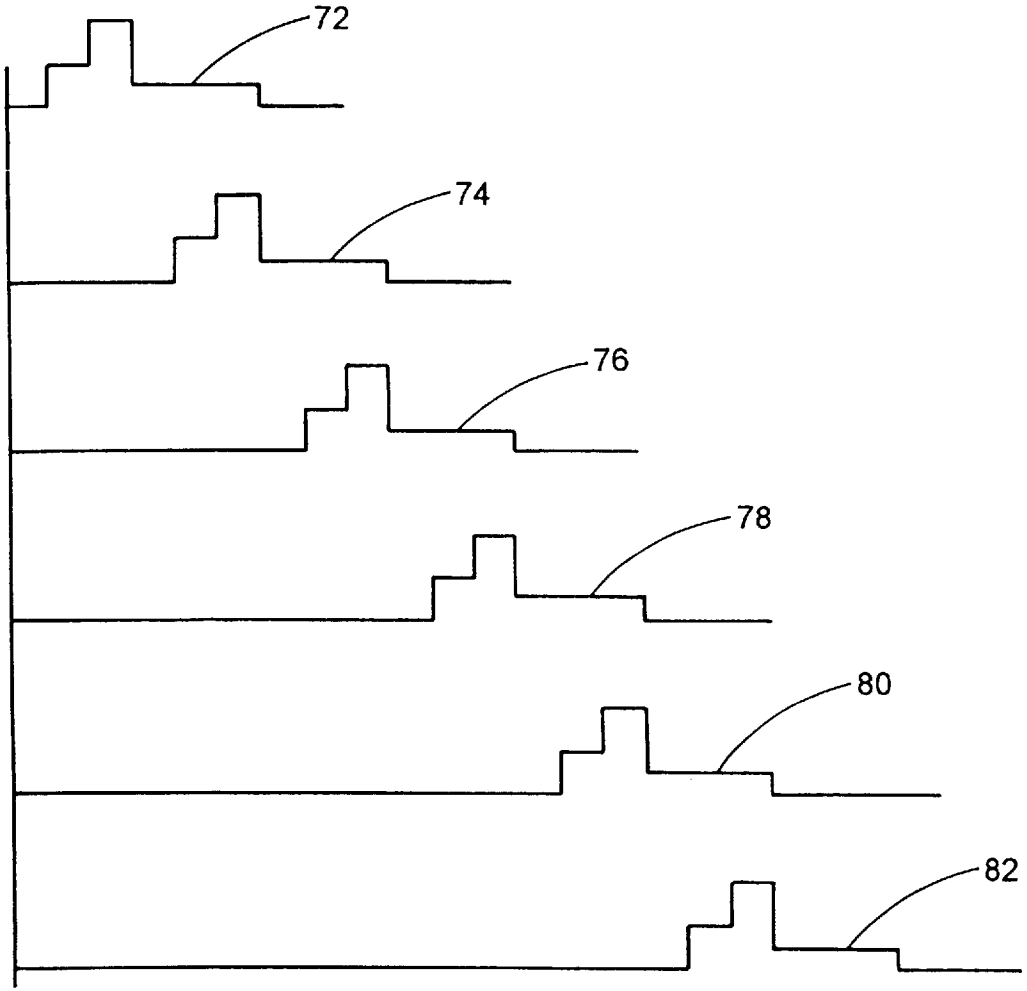
FIG. 10 is a chart showing the staggered current profiles of six fuel injectors.

Referring to FIG. 9, the method of the present invention can be used to control multiple valve solenoids 22*a*, 22*b*, 22*c*. As long as the cycle times of the valves do not overlap one another, then the same current controller 62, having the one-shot devices 44, 54 and operational amplifiers 50, 60, 64 described above can be used to control each of the valve solenoids 22*a*, 22*b*, 22*c*. A switching mechanism 70 selectively connects each of the valve solenoids 22*a,* 22*b,* 22*c* to the current controller 62 to alternate the electrical connection between the valve solenoids 22*a,* 22*b,* 22*c*. Referring to FIG. 10, the current profiles of six fuel injectors 72, 74, 76, 78, 80, 82 are shown. A single current controller 62 can control all of the fuel injectors that have current profiles that do not overlap. Therefore, a single current controller 62 can control the first, third, and fifth fuel injectors 72, 76, 80, and a second current controller 62 can control the second, fourth, and sixth fuel injectors 74, 78, 82.

The foregoing discussion discloses and describes the preferred embodiment. One skilled in the art will readily recognize from such discussion, and from the accompanying drawings and claims, that changes and modifications can be made to the preferred embodiment without departing from the true spirit and fair scope of the inventive concepts as defined in the following claims. The preferred embodiment has been described in an illustrative manner, and it is to be understood that the terminology which has been used is intended to be in the nature of words of description rather than of limitation.

What is claimed is:

1. A method of controlling a fuel injector valve solenoid comprising:

generating a set-point signal to model a desired current profile flowing through the valve solenoid;

providing a current controller adapted to regulate the current flowing through the valve solenoid; and regulating the current flowing through the valve solenoid such that the current flowing through the valve solenoid closely matches the set point signal.

2. The method of claim 1 wherein regulating the current includes:

measuring the current flowing through the valve solenoid;

comparing the current flowing through the valve solenoid to the current profile of the set-point signal; and adjusting the current flowing through the valve solenoid to more closely match the current profile of the set-point signal.

3. The method of claim 2 wherein the current controller includes an operational amplifier, a field effect transistor, and a feedback loop, wherein the field effect transistor is positioned in series with the valve solenoid and the operational amplifier is adapted to receive the set point signal, measure the current flowing through the field effect transistor via the feedback loop, and adjust the current flow through the field effect transistor to more closely match the current profile of the set-point signal.

4. The method of claim 1 wherein the set-point signal includes a pre-charge phase, a peak phase, and a hold phase, the method including establishing a pre-charge time, a pre-charge amplitude, peak time, a peak amplitude, a hold time, and a hold amplitude and generating a set point signal includes generating a current profile having a pre-charge phase at the pre-charge amplitude for the pre-charge time, a peak phase at the peak amplitude and for the peak time, and a hold phase at the hold amplitude for the hold time.

5. The method of claim 4 wherein the amplitude of the current in the pre-charge phase is not sufficient to cause the valve to open, the amplitude of the current in the peak phase is substantially higher than necessary to cause the valve to open, and the amplitude of the current in the hold phase is sufficient to keep the valve open.

6. The method of claim 4 including providing an input signal that defines a hold pulse having the hold amplitude and a duration of the sum of the pre-charge time, the peak time, and the hold time.

7. The method of claim 6 including providing a first edge triggered one-shot device adapted to generate a peak pulse, having an amplitude equal to the peak amplitude less the hold amplitude and a duration equal to the combined pre-charge time and peak time, in response to receiving the hold pulse, the method including generating the peak pulse.

8. The method of claim 7 including providing a first inverting summer operation amplifier adapted to combine and invert two incoming signals, the method including sending the peak pulse and the hold pulse to the first inverting summer operational amplifier and generating a peak-hold pulse.

9. The method of claim 8 including providing a second edge triggered one-shot device adapted to generate a pre-charge pulse, having an amplitude equal to the difference between the peak amplitude and the pre-charge amplitude and a duration of the pre-charge time, in response to receiving the hold pulse, the method including generating the pre-charge pulse.

10. The method of claim 9 including providing a second inverting summer operation amplifier adapted to combine and invert two incoming signals, the method including sending the peak-hold pulse and the pre-charge pulse to the second inverting summer operational amplifier and generating the set-point signal.

11. A device for controlling the current flowing through a valve solenoid of a fuel injector comprising:

a circuit adapted to generate a set-point signal defining the desired current profile of the current flowing through the valve solenoid;

a current controller adapted to regulate the current flowing through the valve solenoid to match the current profile of the set-point signal.

12. The device of claim 11 wherein the current controller comprises an operational amplifier, a field effect transistor mounted in series with a valve solenoid, and a feedback loop, wherein said operational amplifier is adapted to receive the set-point signal and to receive the current flowing through said field effect transistor, via said feed back loop, whereby said operation amplifier compares the current profile of the set-point signal to the current profile flowing through the field effect transistor and regulates the current flow through the field effect transistor to more closely match the current profile of the set-point signal.

13. The device of claim 11 wherein the circuit comprises:

a first edge triggered one-shot device adapted to generate a peak pulse in response to receiving an input pulse;

a first inverting summer operational amplifier adapted to generate a peak-hold pulse in response to receiving the peak pulse and the input pulse;

a second edge triggered one-shot device adapted to generate a pre-charge pulse in response to receiving the input pulse; and a second inverting summer operation amplifier adapted to generate said set-point signal in response to receiving the pre-charge pulse and the peak-hold pulse.

14. The device of claim 13 further including a switching device adapted to selectively connect said current controller to a plurality of valve solenoids, such that said current controller can control the current flowing through each of the plurality of valve solenoids.

* * * * *